United States Patent [19]

McCaffrey

[11] Patent Number: 4,573,523

[45] Date of Patent: Mar. 4, 1986

[54] METHOD OF AND APPARATUS FOR CONTINUOUS CENTRIFUGAL CASTING

[75] Inventor: Felim McCaffrey, Toronto, Canada

[73] Assignee: Hatch Associates Ltd., Totonto, Canada

[21] Appl. No.: 668,990

[22] Filed: Nov. 5, 1984

[51] Int. Cl.[4] ..... B22D 11/06; B22D 11/126; B22D 13/02

[52] U.S. Cl. ..... 164/460; 164/263; 164/422; 164/431; 164/464; 164/481

[58] Field of Search ..... 164/460, 464, 465, 479, 164/481, 421, 422, 430, 431, 432, 263

[56] References Cited

U.S. PATENT DOCUMENTS 2,359,453 10/1944 Waldron ..... 164/421 X
3,844,332 10/1974 Bucci ..... 164/460

FOREIGN PATENT DOCUMENTS 900022 9/1944 France ..... 164/430
1049394 8/1953 France ..... 164/421

*Primary Examiner*—Nicholas P. Godici
*Assistant Examiner*—J. Reed Batten, Jr.
*Attorney, Agent, or Firm*—Ridout & Maybee

[57] ABSTRACT

A continuous centrifugal casting machine employs a rotating water cooled mould in which a tubular mould cavity is formed by a number of pallet conveyors, each having an upper run defining a part cylinder. The conveyors are driven so that the tubular mould which they form moves with the casting, thus eliminating relative movement between the mould and the casting. The conveyors are housed inside a rotating drum so that centrifugal force causes molten metal such as steel poured against the wall of the mould cavity at one end to form a comparatively thin walled tube which is withdrawn from the other end of the mould cavity. The tube may be spirally slit to form sheet.

11 Claims, 3 Drawing Figures

METHOD OF AND APPARATUS FOR CONTINUOUS CENTRIFUGAL CASTING

Figure 1:
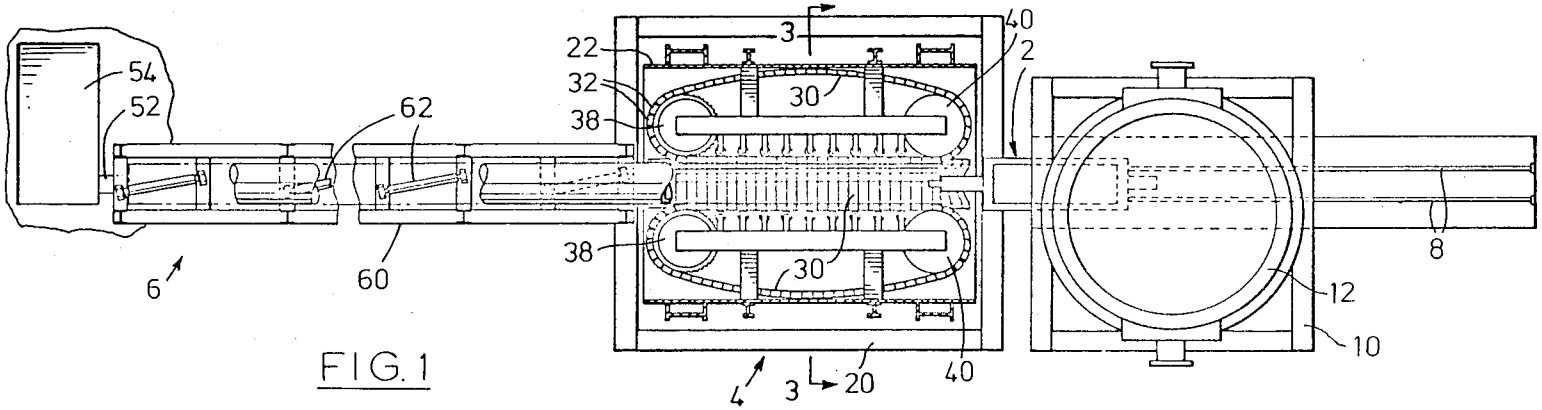

This invention relates to the formation of sheet metal, such as steel, by continuous casting.

Continuous casting has been extensively adopted in the formation of steel into billets, blooms and slabs, but such material requires considerable further hot working to convert it into sheet, which is expensive in terms of the plant required, energy consumption, and material losses due to scaling. Direct casting of steel sheet is not practicable with conventional continuous casting techniques because of problems due to excessive frictional drag in the mould, and difficulties in producing sections of sufficiently small thickness.

It is known to utilize centrifugal casting to cast tubes of comparatively small wall thickness, and proposals have been made to cast such tubes in a continuous manner, which tubes can subsequently be processed to provide sheet or other sections. Examples of these and similar techniques for the continuous centrifugal casting of tubes are provided by U.S. Pat. Nos. 1,223,676 (Lavaud), 1,444,953 (Crane), 1,864,270 (Eurich et al), 2,408,514 (Hazelett), 2,477,030 (Wuetig), 2,707,813 (Dickson), 2,752,648 (Robert), 2,940,143 (Doubersy), 3,445,922 (Leghorn), 3,367,400 (Hathorn), 3,625,276 (Considine) and 3,771,587 (Poran). Of these patents, the Wuetig patent discloses a system in which a tube is centrifugally cast in a spirally ribbed mould, and then spirally peeled away to form a strip. The Leghorn patent discloses subsequent treatment of the tube to form other sections. The Hazelett patent discloses continuous casting of a spiral strip within a tubular mould, overlapping edges of successive spirals being welded together by rolling to form a continuous tube. With the exception of Wuetig, whose process is not continuous, all of the above proposals require relative movement between the cast tube and the mould. Such movement engenders severe problems in providing adequate lubrication and preventing fracture of the casting during formation.

In an attempt to tackle the limitations imposed upon continuous casting techniques by the difficulties involved in keeping the casting moving through the mould without jamming or disruption, proposals have been made for continuous casting machines in which the mould is formed by cooperating endless belts of mould segments. Proposals for such machines have been made in U.S. Pat. Nos. 1,841,297 (Perry et al), 2,640,235 (Hazelett), 2,664,607 (Hunter), 2,904,860 (Hazelett) and 4,331,195 (Webber). Such machines have achieved some success in the casting of non-ferrous metals, although the minimum thickness of metal which can be so cast is still substantial, and the technique has not found acceptance in the casting of ferrous metals, possibly because of the difficulty of extracting heat from the metal at a sufficient rate to allow adequate solidification and avoid overheating of the belts. These problems are aggravated in that the melting range of steels is often substantial, thus still further increasing the rate at which heat must be extracted.

An object of the present invention is to provide a method and apparatus for the continuous casting of metals, including ferrous metals, into tubes which can be rendered into sheet by slitting.

According to the invention, apparatus for the continuous casting of metal comprises a tubular mould having an inner wall formed by cooperation of pallets in adjacent runs of a plurality of endless belts each formed of plural pallets and disposed around and extending longitudinally of the mould, a common frame supporting said belts, means to drive said belts so that the inner wall formed by said pallets of said belts moves continuously through the tubular mould formed thereby from one end to the other, means for rotating said common frame and said belts about a longitudinal axis of said mould, means to supply molten metal to said inner wall at said one end of the tubular mould, means to cool said mould whereby to solidify said molten metal on said inner wall, and means to withdraw a tube formed by said solidified metal from the other end of said tubular mould. The invention also extends to a method of continuous casting using such apparatus.

As compared with known means for continuous centrifugal casting, the above apparatus has the advantage that there is no relative movement between the mould and the casting, whilst as compared with known continuous belt casting machines the cooling problem is much reduced since only a thin coreless shell of metal requires to be cooled, the surface area of the mould structure available for heat removal being much larger relative to the mass of metal handled than in conventional continuous casting machines.

Figure 2:
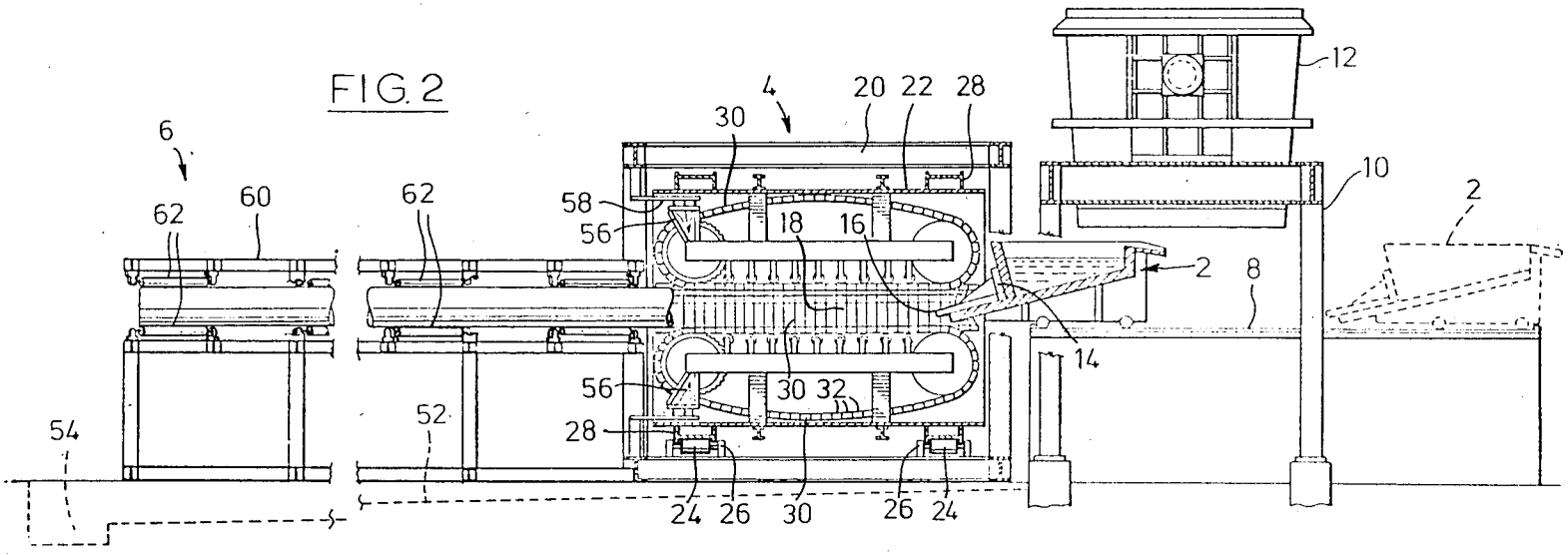
Figure 3:
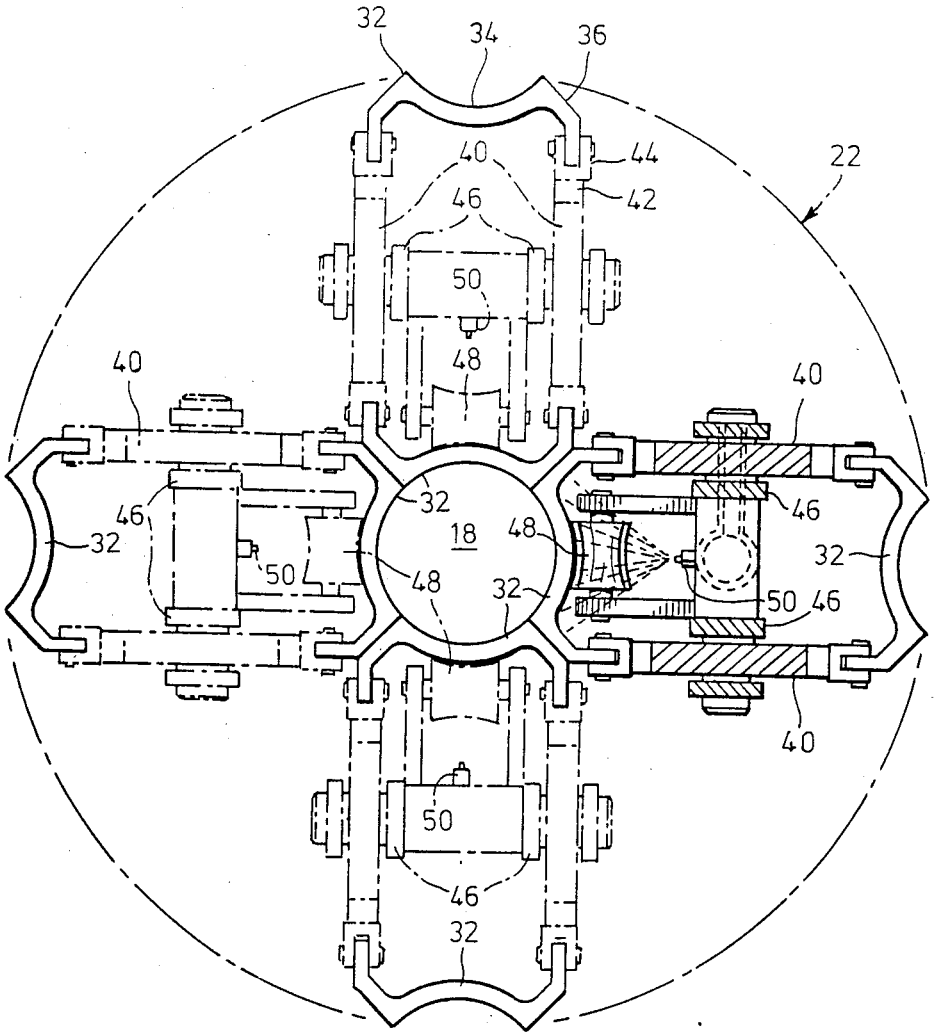

Further features of the invention will become apparent from the following description of a presently preferred embodiment with reference to the accompanying drawings, in which:

FIG. 1 is a part longitudinal horizontal section, part plan view of the apparatus, FIG. 2 is a part vertical longitudinal section and part elevation of the apparatus of FIG. 1; and FIG. 3 is a partial transverse section through the rotating portion of the apparatus along the line 3—3 in FIG. 1, with most duplicated components omitted for the sake of clarity.

The continuous casting machine shown in the drawings comprises a tundish 2, a mould unit 4 and a cooling section 6.

The tundish 2 is supported by wheels on a runway 8 beneath a stand 10 supporting a ladle 12. The tundish may move on the runway between a preheat station, where it is shown in broken lines, and a pouring position beneath the ladle, shown in full lines, at which station molten metal may be released from the ladle into the tundish and thence through a slide gate 14 and a refractory nozzle 16 onto a lower surface of one end of the wall defining a horizontally elongated tubular mould cavity 18.

The mould unit 4 comprises a supporting frame 20 supporting for rotation a large diameter cylindrical drum 22 which contains the mould assembly proper. The drum is supported and guided in the frame for rotational movement by support and thrust rollers 24 and 26 engaging drive rings 28 attached to the outer periphery of the drum. In a preferred arrangement, these rings form rotor elements of an induction motor providing rotation of the drum, the exciting coils being supported by the frame 20.

Within the drum are mounted four identical longitudinally extending moving pallet conveyors 30, one in each quadrant of the drum. The pallets 32 making up the belts of the conveyors are configured (see FIG. 3) so that their outer surface 34 (with reference to the belt) is a quarter-cylindrical trough which in the inward facing run of the belt subtends an angle of 90° at the axis of the drum. The adjacent portions 36 of the side walls of the pallets are disposed so that in the inward run of the belt they extend radially from the axis of the drum. Thus the inward facing runs of the belts cooperate to form the tubular mould cavity 18. Various measures are taken to obtain a tight fit between the pallets forming the mould wall defining the cavity 18. The belts are supported on driver and idler sprockets 38 and 40 by teeth 42 formed on lines 44 connecting flanges on the inner side (relative to the belts) of adjacent pallets to form the belts, and the sprockets are supported from the drum 22 by beams 46 which also carry a plurality of adjustable idler rolls 48 bearing on the pallets 32 so as to maintain their radial position as they move along the mould cavity 18. Since the links are on radially outward portions of the pallets on the inner run of the belts, the abutting surfaces of adjacent pallets can be profiled so that they will be in tight abutment when centrifugal force presses them against the roller rolls 48, even though the belt is maintained in tension by centrifugal force acting on the outer run of the belt. In this outer run and around the sprockets the adjacent pallets will pivot apart to allow ejection of any foreign matter trapped between the pallets. The pallets themselves are formed from a high tensile, high thermal conductivity fatigue resistant alloy such as the copper-chromium-zirconium alloy sold under the trade mark ELBRODUR-RS and containing 0.65% by weight Cr, 0.10% Zr, the remainder being Cu. This alloy has excellent thermal conductivity, high fatigue resistance, and a high recrystallization temperature, thus enhancing its ability to stand up to the conditions applied to it in the present application. Cooling of the mould walls defined by the pallets 32 around the mould cavity 18 may be effected by water spray nozzles 50 mounted on the beams 46 as shown. Alternatively, the nozzles may be mounted externally of the drum, which in this case must be of openwork construction to allow adequate impingement of the spray on the belts. Surplus water escaping from the drum 22 is captured by a flume 52 extending beneath the apparatus, this flume also capturing scale falling from the apparatus, which is washed by the water into a scale pit 54. The driven sprockets 38 have drive motors (not shown) having current pick up shoe assemblies 56 engaging a slip ring assembly 58 supported by the frame 20 concentrically within the downstream end of the drum 22.

The cooling section 6 incorporates a tubular frame 60 axially aligned with the tubular mould cavity 18, the frame being provided with skew rollers 62 for supporting and scaling during cooling a cast tube emerging from the mould cavity 18.

In use, the preheated tundish 2 would be filled with molten metal, for example, steel, from the ladle 12 and advanced to the pouring position, whilst the drum 20 and the belts 30 are brought up to speed by their respective motors. Typical speeds, assuming a 60 cm diameter for the mould cavity 18, might be about 200 rpm for the drum 22, and about 30 meters/minute for the belts 30. The gate 14 on the tundish 2 is then opened, allowing molten steel to pour through the nozzle 16 onto the bottom of the upstream end of the cavity 18. The rate of pouring is typically such as to maintain the metal layer thickness on the cavity walls of about 1.25 cm as the layer is carried away by movement of the belts 30. Because of this comparatively thin layer, the water sprays 50 can maintain adequate cooling of the pallets 32, thus preventing the alloy from which they are made from being raised to a temperature at which its properties are endangered and enabling a rapid rate of cooling of the steel to be maintained. Moreover, since each pallet spends less than half its time actually forming part of the mould wall, further cooling takes place around the sprockets and in the outer run of each conveyer.

The absence of relative movement between the cast tube formed as the steel solidifies avoids damage to the casting and overcomes the wear and fabrication problems normally associated with continuous casting moulds. Since the relatively thin layer of metal can be solidified rapidly, the casting emerging at the downstream end of the mould has sufficient strength that horizontal operation of the casting apparatus is possible, whereas conventional continuous casting machines require both the mould and the initial portion of the cooling section to be vertical, with a gradual transition to the horizontal, thus producing apparatus of substantial height which must be accommodated by correspondingly tall and strong structures, and provided with means to raise molten metal to the top of the caster.

The tube produced by the casting apparatus of the present invention may be slit longitudinally or spirally to form 1.25 cm (typically) thick sheet without the use of the hot rolling mill required in conjunction with a conventional continuous caster to reduce the billets produced by the latter to sheet. Not only does this save the capital cost of the hot rolling, but scaling losses are greatly reduced and the energy normally required to reheat the billets during hot rolling is saved.

An advantage of the construction described is that the mould surfaces may be cleaned or machined in situ, simply by introducing a suitable tool into the bore formed by the pallets so that the forward movement and rotation of the pallets progressively exposes the mould forming surfaces to the tool.

I claim:

1. Apparatus for the continuous casting of metal comprising a tubular mould having an inner wall formed by cooperation of pallets in adjacent runs of a plurality of endless belts each formed of plural pallets and disposed around and extending longitudinally of the mould, a common frame supporting said belts, means to drive said belts so that the inner wall formed by said pallets of said belts moves continuously through the tubular mould formed thereby from one end to the other, means for rotating said common frame and said belts about a longitudinal axis of said mould, means to supply molten metal to said inner wall at said one end of the tubular mould, means to cool said mould whereby to solidify said molten metal on said inner wall, and means to withdraw a tube formed by said solidified metal from the other end of said tubular mould.

2. Apparatus according to claim 1, wherein the inner run of each belt forms a horizontally extending part cylindrical trough, and the troughs cooperate to form a horizontal extending tubular cylindrical mould cavity.

3. Apparatus according to claim 2, wherein the belts are mounted within a cylindrical drum coaxial with the mould cavity, and means are provided for supporting said drum for rotation about its axis, and for rotating said drum.

4. Apparatus according to claim 2, wherein the means to supply molten metal is a tundish supported to pour molten metal onto the lower portion of said inner wall at one end of the tubular mould, and the means to withdraw the tube is a conveyor coaxially supporting the tube for rotation and forward movement as it leaves the other end of the tubular mould.

5. Apparatus according to claim 4, wherein the conveyor is a skewed roller conveyor.

6. Apparatus according to claim 3, wherein the belts are supported within the drum by sprockets, and pallets in the inner run of each conveyor are further supported by back-up rolls.

7. Apparatus according to claim 6, wherein the sprockets and back-up rolls are supported within the drum by longitudinal beams within the conveyor runs.

8. Apparatus according to claim 6, wherein the pallets of the belts are formed of a high conductivity, high tensile copper alloy, and adjacent pallets are connected at their sides opposite their mould forming cavities by links forming teeth which engage the sprockets.

9. A method for the continuous casting of metal, comprising pouring molten metal onto the inner wall of a tubular mould at one end thereof, the mould being formed by pallets of cooperating inward facing runs of a plurality of continuously moving conveyor belts, so that the inner wall of said tubular mould advances continuously from said one end to the other end of the mould, conjointly rotating said plurality of belts about the longitudinal axis of said tubular mould so as centrifugally to distribute said molten metal over said inner wall to form a tubular layer, cooling said mould pallets to solidify the metal, and withdrawing the cast tube so formed from the other end of said mould.

10. A method according to claim 9, wherein the molten metal is a ferrous metal.

11. A method according to claim 9, wherein the cast tube is spirally slit to form a strip of metal sheet.

* * * * *